US011708647B2

(12) United States Patent
Hermes et al.

(10) Patent No.: US 11,708,647 B2
(45) Date of Patent: Jul. 25, 2023

(54) APPARATUS FOR MAKING MELT-BLOWN MULTILAYER NONWOVEN

(71) Applicants: Raphael Hermes, Niederkassel (DE); Markus Wuescht, Rheinbach (DE)

(72) Inventors: Raphael Hermes, Niederkassel (DE); Markus Wuescht, Rheinbach (DE)

(73) Assignee: PARAT BETEILIGUNGS GMBH, Neureichenau (DE)

( * ) Notice: Subject to any disclaimer, the term of this patent is extended or adjusted under 35 U.S.C. 154(b) by 165 days.

(21) Appl. No.: 17/189,341

(22) Filed: Mar. 2, 2021

(65) Prior Publication Data

US 2021/0285129 A1 Sep. 16, 2021

(30) Foreign Application Priority Data

Mar. 10, 2020 (DE) ..... 102020106532.9

(51) Int. Cl.
*D01D 4/02* (2006.01)
*D04H 1/56* (2006.01)
*D01D 5/08* (2006.01)

(52) U.S. Cl.
CPC ..... *D01D 4/025* (2013.01); *D01D 5/08* (2013.01); *D04H 1/56* (2013.01)

(58) Field of Classification Search
CPC ..... D01D 4/025; D01D 5/08; D04H 1/56; D04H 1/565; D04H 1/70; D04H 1/732; D04H 1/736; D04H 3/02; D04H 3/16
See application file for complete search history.

(56) References Cited

U.S. PATENT DOCUMENTS 6,499,982 B2 * 12/2002 Allen ..... D04H 1/70 425/73
7,390,760 B1 6/2008 Chen

FOREIGN PATENT DOCUMENTS

DE 19913162 B 11/2000
WO 2015176983 A 11/2015

OTHER PUBLICATIONS

Machine translation of DE 19913162, Nov. 9, 2000 (Year: 2000).*

* cited by examiner

*Primary Examiner* — Xiao S Zhao
*Assistant Examiner* — Joseph S Leyson
(74) *Attorney, Agent, or Firm* — Andrew Wilford

(57) ABSTRACT

An apparatus for making nonwoven has a mesh belt moving in a horizontal direction and upstream and downstream spinnerets spaced apart in the direction above the belt and having downwardly opening tips at respective vertical spacings above the belt and each emitting fibers that are deposited at locations on the belt directly below the spinnerets to form thereon respective nonwoven layers. A support carrying the belt can be moved vertically and pivoted to orient the belt into a position forming an acute angle with respect to horizontal and thereby vary the spacings.

11 Claims, 3 Drawing Sheets

APPARATUS FOR MAKING MELT-BLOWN MULTILAYER NONWOVEN

FIELD OF THE INVENTION

The present invention relates to an apparatus for making a nonwoven. More particularly this invention concerns the manufacture of a multilayer melt-blown nonwoven.

BACKGROUND OF THE INVENTION

A multilayer nonwoven is typically made by an apparatus having at least two melt-blowing upstream and downstream spinnerets or spinneret beams, for making melt-blown fibers. A mesh-belt system or table is underneath the spinnerets gas at least one endlessly revolving mesh belt.

The melt-blown fibers emitted by the spinnerets drop onto respective upstream and downstream deposition locations of the moving belt and form respective layers. Each of the spinnerets has a downwardly open tip from which the respective fibers are emitted, and each of these tips is space vertically above the between the nozzle tips and a surface of the mesh belt.

Such an apparatus for making nonwoven is basically known from practice. Critical to the process parameters are the spacings of the spinneret tips above the belt. These spacings often differ from one another and therefore must be individually adjusted depending on the nonwoven produced. Here there is the known apparatus for making nonwovens with setting of the spacings effected by a height adjustment of the melt-blowing spinnerets or melt-blowing spinneret beams. This is due to the fact that the mesh belt for both melt-blowing spinnerets forms a common reference plane, so that a height adjustment of the mesh belt results in the spacings A1 or A2 varying equally and individual setting of the spacings over a height adjustment of the mesh belt not being possible.

However, the height adjustment of the melt-blowing spinnerets is very complex.

Objects of the Invention

It is therefore an object of the present invention to provide an improved apparatus for making melt-blown mulitlayer nonwoven.

Another object is the provision of such an improved apparatus for making melt-blown mulitlayer nonwoven that overcomes the above-given disadvantages, in particular that reduces the complexity and cost of changing the spacings.

SUMMARY OF THE INVENTION

An apparatus for making nonwoven has a mesh belt moving in a horizontal direction and upstream and downstream spinnerets spaced apart in the direction above the belt and having downwardly opening tips at respective vertical spacings above the belt and each emitting fibers that are deposited at locations on the belt directly below the spinnerets to form thereon respective nonwoven layers. A support carrying the belt can be moved vertically and pivoted to orient the belt into a position forming an acute angle with respect to horizontal and thereby vary the spacings.

In other words, the mesh belt or a surface of the of the mesh belts facing the melt-blowing spinnerets is orientable obliquely with respect to a horizontal h for changing the spacing A1 and/or A2.

The invention is based on the discovery that the apparatus for making nonwovens will need to be even more flexible in the future. These increased demands on flexibility of the adjustments of the spacings in a conventional manner by adjustment of the heights of the melt-blowing spinnerets appear increasingly unattractive. The object of the invention is also to allow an inclined position of the mesh belt that offers an additional degree of freedom in adjusting the mesh belt, so that the individually changing the spacings is possible. The invention thus pursues a radical, new approach through which the previous, very complex height adjustments of the melt-blowing spinnerets are not required. As a result, the above-mentioned object is attained. According to a particularly preferred embodiment, the mesh-belt system or the mesh-belt table is pivotable for the inclined orientation or for changing the spacing A1 and/or A2 about at least one pivot axis, in particular about one or only one pivot axis. The term "pivotable" means there is in particular a special apparatus or pivoting device on the mesh-belt system.

It is very preferred that the mesh belt has pivoting means. The this pivoting means can in particular have one or more rollers or a pivot axis or a pivot shaft. The pivoting means preferably comprises at least one actuator, more preferably at least two and particularly preferably at least four actuators. The actuator or actuators may, for example, be pneumatic or hydraulic or electromechanical cylinders. Beyond that, however, there are also completely different drives conceivable, including, for example, an electric motor with a spindle. It is very preferred that at least one actuator is provided at each end of the pivot axle. It is useful if in a plan view and in relation to the machine direction at least one actuator and preferably two actuators flanking the mesh belt are provided on the mesh-belt system. It is particularly preferred when on each side of the pivot axis there is a respective pair of actuators, preferably with the actuators of each pair spaced apart along the machine direction with an actuator to the left of the mesh belt and an actuator to the right of the mesh belt. It is possible for the pivot means to have springs, for example coil springs, to support the actuators.

It is particularly preferred that for changing the spacing A1 and/or A2 the mesh belt can be raised or pivoted. It is particularly preferred for setting the spacings to be different, that the mesh belt be both lifted and pivoted. If there is the possibility of pivoting as well as lifting one has two degrees of freedom, which especially within a certain range of possible changes in the height position makes any combination of spacings possible.

It is very preferred that the pivot axis extends perpendicular or in a plan view essentially perpendicular to the machine direction (MD) or to the longitudinal extension of the mesh-belt system or the mesh belt. It is useful when the mesh-belt system has two side walls. The side walls extend on the left or right side, based on the machine direction, parallel to the mesh-belt transport direction. The mesh-belt system advantageously comprises at least two, more preferably at least four or six or eight rollers. It is preferred that the side walls carry the rollers. It is preferred that the mesh-belt rollers guide or drive the mesh belt. The mesh belt can have a connecting seam for making it annular or can be woven as one annular piece. It is advantageous that the mesh belt has formations with the help of which the endless mesh belt can be entrained. This can include rollers or moving parts carried on to the side walls.

It is very preferred that the at least two melt-blowing spinnerets each have a respective deposition location. The deposition locations are conveniently located below the respective melt-blowing spinnerets. The mesh-belt system preferably comprises for each melt-blowing spinneret at least one air duct for sucking in air at the respective deposition location on the mesh belt. It is preferred that the at least two air ducts lie between upper and lower reaches of the mesh belt. The two air ducts can be connected to a common blower or to different blowers. The air ducts are designed so that they draw air through the mesh belt or the mesh belts from top to bottom.

It is advantageous if the pivot axis is, relative to the longitudinal extension of the mesh-belt system, in the middle third/quarter/fifth/sixth and preferably in the middle or is arranged essentially in the middle of the mesh belt. It is preferred when the mesh-belt system is designed like a rocker above the pivot axis. It is basically possible that the pivot axis in side view of the mesh-belt system is in a left or right third or at a left or right end of the mesh-belt system.

According to a preferred embodiment, a position angle $\alpha$ defined between the surface of the mesh belt facing the melt-blowing spinnerets and the horizontal h is between −10° and +10°, in particular between −8° and +8° and preferably between −7° and +7° and particularly preferably between −6° and +6°. The invention is based on the discovery that the nonwoven is not adversely affected at such small angles.

It is preferred that the vertical adjustment range $\Delta h$ between a deposition location on the surface of the mesh belt for the melt-blown fibers when oriented at an angle to the mesh-belt system and this deposition location in the horizontally oriented state the mesh belt is offset by 100 to 500 mm, preferably 120 to 400 mm and especially preferably 140 to 350 mm. It was found that a corresponding vertical difference in height is sufficient to cover the spacing A1 and/or A2 at least for changing of the height adjustments that occur in practice sufficiently.

According to one embodiment, the mesh belt is an endlessly circulating single mesh belt, so that the melt-blown fibers from the at least two melt-blowing spinnerets are preferably deposited in at least two layers of melt-blown nonwoven. Due to the placement of the relatively hot fibers of the second melt-blowing spinneret on those of the first melt-blowing spinneret a slight bonding has already taken place, so that a subsequent bonding device that can better secure the two layers to one another is not absolutely necessary.

According to a very preferred embodiment, the mesh belt comprises at least two, if necessary only two, mesh belts. It is possible that the two belts define a transfer area. It is advantageous when the mesh-belt surfaces facing the spinnerets in side view lie are aligned. It is advantageous if the ends of the mesh belts defining the transfer area have a height difference of not more than 100 mm or 70 mm or 50 mm or 30 mm or 20 mm.

It is possible that the at least two or the only two endlessly circulating mesh belts circulate in the same direction or in opposite directions. It is possibly of advantage if the mesh belts are operated at different speeds.

According to one embodiment, the apparatus for making nonwoven or the mesh-belt system is designed so that at least one, in particular only one, melt-blown nonwoven web is passed in at least part of its transport path below the mesh-belt system. It is possible that the melt-blown nonwoven web is deflected downward in the transfer area and then guided by rollers below the second mesh belt or below the returning sections of the second mesh belt. It is basically possible that the melt-blown nonwoven webs of the two or several melt-blowing spinnerets are deflected down in the transfer area and then transported away below the first and/or second mesh belt via nonwoven web rollers.

It is possible that at least two, in particular only two, melt-blown nonwoven webs each can be transported away on the upper side of the mesh-belt system. According to one embodiment the at least two melt-blown nonwoven webs are in different embodiments transported away in different directions and preferably separated. It is possible that the fibers of the first melt-blowing spinneret initially form a nonwoven layer on the first mesh belt that then passes via the transfer area onto the second mesh belt, where the fibers of the second melt-blowing spinneret then form a second layer on top of the first nonwoven web or first layer.

According to a preferred embodiment, the apparatus for making nonwoven is designed so that the first and second melt-blowing spinnerets form first and second nonwoven webs, the first and the second nonwoven web only being laminated together after leaving the mesh belt.

It is within the scope of the invention that a consolidator is provided downstream of the mesh-belt system, in particular a combination device for solidification or lamination of two or more layers. The consolidater can in particular effect a chemical and/or mechanical and/or thermal consolidation of a nonwoven web or several layers of a nonwoven. The calender can be a so-called needling device using a fluid.

The invention relates to an apparatus for making nonwoven with at least two spinnerets for making two types of fibers. Such devices are already known from practice and can combine the properties of two fiber types in a nonwoven. For this purpose, the fibers of the first spinneret are deposited on a mesh-belt system, which has an endlessly revolving mesh belt. Fibers of the second spinneret are placed on the fibers of the first spinneret so that a nonwoven with two layers is created and the properties of two different fiber types in combined in a nonwoven laminate.

However, due to the immediate deposition of the fibers of the second spinneret on those of the first spinneret, there is an often undesired thermal lamination, because the fibers of the second spinneret are being deposited while still hot. The two layers might preferably only be connected to one another by mechanical solidification, for example by needling. In addition, it can be, for example, that fibers from three spinnerets are combined to one nonwoven. It may be that the middle spinneret does not create the core of the three fiber layers, but rather one of the two outer fiber layers. The invention is therefore based on the object of eliminating the above-mentioned disadvantages.

This object is attained by a nonwoven-making apparatus, in particular with at least one feature of the above-mentioned invention apparatus for making nonwovens with at least two spinnerets, in particular at least two melt-blowing spinnerets or at least two spinneret beams or at least one melt-blowing spinneret and at least one spinneret beam for making fibers, where one mesh-belt system or a mesh-belt table is provided, in particular with at least one feature of the above-mentioned mesh-belt systems according to the invention, and the fibers of the spinnerets are deposited on the mesh-belt system, the mesh-belt system having at least two endlessly revolving mesh belts.

This invention is based on the discovery that two endlessly rotating mesh belts offer a large number of possibilities for manipulating the nonwovens to be produced. For example a first nonwoven web of the first spinneret is deflected in a transfer area between the mesh belts downward and guided below the second mesh belt so that the two nonwoven webs are only brought together after leaving the mesh-belt system. This can prevent the second fibers from heat bonding to the first nonwoven web. In addition, the nonwoven webs of the spinnerets can move in different directions and be transported away, so that turning a nonwoven web is possible and the layers of the nonwoven can be put together in a different order. The result is that above-mentioned objects are attained.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
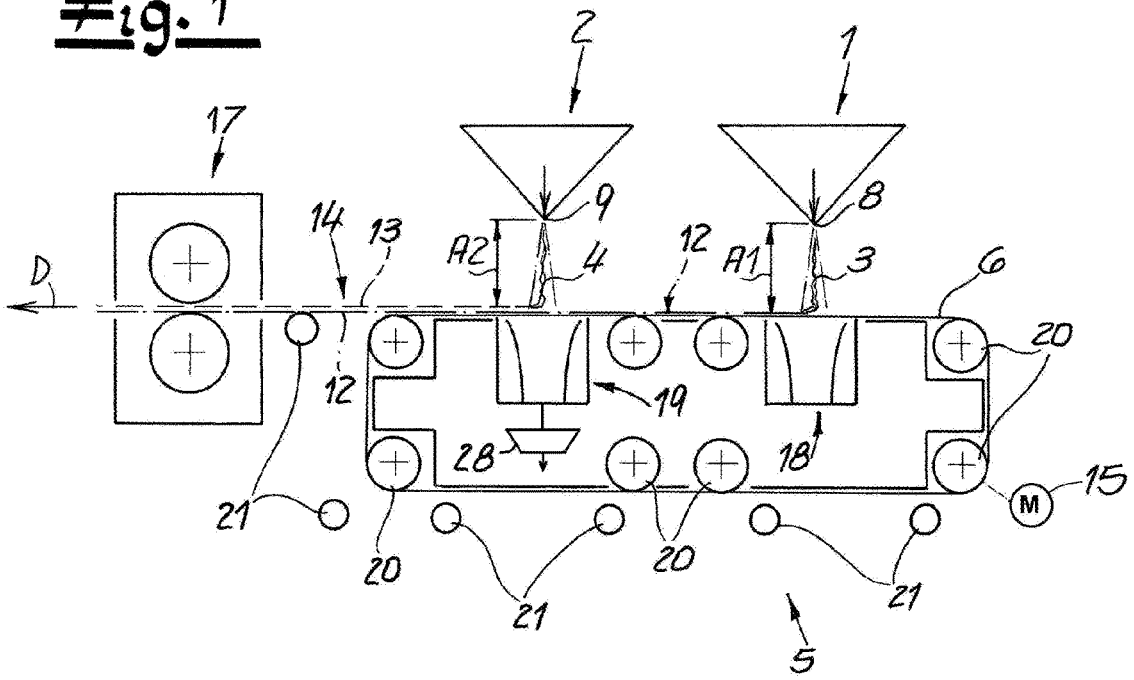
FIG. 1 is a schematic side view of a first embodiment of an apparatus for making nonwoven according to the invention with a first mesh-belt system according to the invention.

As seen in FIG. 1 an apparatus for making nonwoven according to the invention has two melt-blowing spinnerets 1 and 2. Below the melt-blowing spinnerets 1 and 2 there is a mesh-belt system 5 with a single endless circulating mesh belt 6. The rotating mesh belt 6 here is guided over eight rollers 20 and is driven by a motor 15 so that its upper reach moves in a direction D. The upper reach of the mesh belt 6 faces the melt-blowing spinnerets 1 and 2 face. A lower reach of the belt of the system 5 runs opposite to this transport direction D.

First and second air ducts 18 and 19 open upward between the upper and lower reaches of the mesh belt 6, respectively below the first and second spinnerets 1 and 2. The air ducts 18 and 19 can be connected to a common blower or each have their own blower such as shown schematically at 28. Air moves downward in the ducts 18 and 19 so as to be sucked in from above the mesh belt 6 and pass through holes in the mesh belt 6 into the air ducts 18 and 19. The air ducts 18 and 19 are directly below the respective deposition location or the respective melt-blowing spinnerets 1 and 2.

Fibers 3 of the first melt-blowing spinneret 1 initially form their own first nonwoven web layer 12. As soon as this layer 12 reaches the deposition location of the second fibers 4, these second fibers 4 form a second nonwoven web layer 13 on top of the first layer 12. The second nonwoven web layer 13 deposited on the first layer 12 forms therewith a multilayer nonwoven 14. After leaving the mesh belt 5, the multilayer nonwoven 14 is passes over a guide roller 21 and to a consolidater 17. The consolidater 17 of this embodiment can be a calender whose rollers compress and heat the multilayer nonwoven 14 to form it into a laminate. Due to deposition of the hot second fibers 4 directly on the first fibers 3 in this embodiment, a first lamination bonding already takes place on deposition, which is why the consolidater 17, in particular, a thermal consolidater 17 is not required for all nonwoven products.

FIG. 1 shows how the two melt-blowing spinnerets 1 and 2 here have respective nozzle tips 8 and 9. The nozzle tip 8 opens at a vertical spacing A1 above the surface of the mesh belt 6, and the nozzle tip 9 similarly is set at a vertical spacing A2 above the surface of the mesh belt 6. The spacings A1 and A2 are set individually and independently of each other in accordance with the type of resin being melt blown, the amount of air cooling desired, and other production factors.

Figure 2:
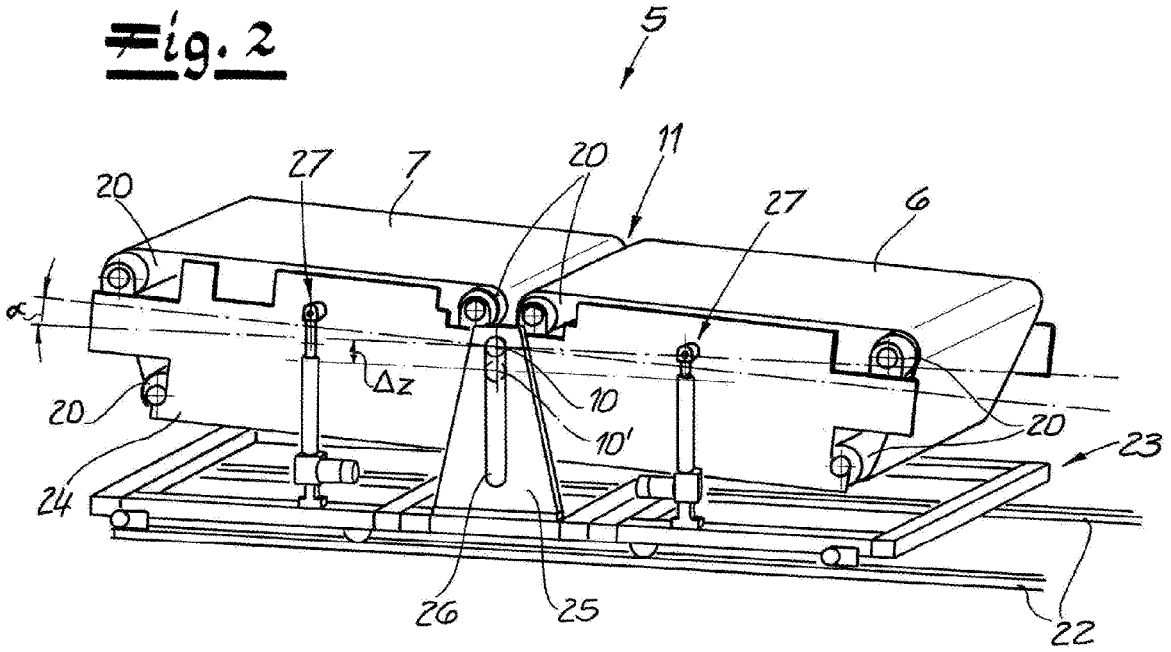
FIG. 2 is a perspective view of a second mesh-belt system according to the invention.

For this reason, the mesh belt 5 according to FIG. 2 has a pivot axis 10 as well as actuators 27 that can pivot the entire mesh-belt system 5 about this axis to a maximum angle $\alpha$. Due to the use of two separate actuators 27, not only can the set angle $\alpha$ be adjusted, but vertical adjustment through a stroke $\Delta z$ is also possible. The two degrees of freedom $\alpha$ and $\Delta z$ make it possible, within a certain framework, to change the spacings A1 and A2 wholly independently of each other.

The actuators 27 may be electromechanical or hydraulic cylinders, for example. They preferably have upper ends connected to side walls 24 forming the support of the mesh-belt system 5. Lower ends of the actuators 27 are preferably mounted on a base formed by a carriage 23 mounted on rails 22. The carriage 23 on the rails 22 permit rapid maintenance of the melt-blowing spinnerets 1 and 2 from below by making it easy to move the entire belt system 5 out of the way from underneath the spinnerets 1 and 2.

The pivot axis 10 of this embodiment may be formed by an axle with roller ends seated in vertical guide slots 26 in upright plates 26 carried on the base 23 and flanking the belt system 5. The opposite and not shown side of the mesh belt 5 is identical or symmetrical to the side shown in FIG. 2. The axle 10 supports the belt system 5 so that it cannot move in the horizontal machine direction D.

The two vertical guide slots 26 in the base plates 25 thus only allow vertical movement, as indicated at a slightly lower set pivot axis 10' in the slots 26. In addition, the pivot guide plates 25 permit rotation, as shown by the position angle $\alpha$. The four actuators 27, two on each side of the belt system 5, work synchronously with the ones shown for rocking about the axle 10 and vertical movement in the guide slots 26. The two upstream (relative to direction D) actuators 27 are controllable independent of the two downstream actuators 27. This independent controllability is what makes two degrees of freedom $\alpha$ and $\Delta z$ possible.

In the embodiment according to FIG. 2, the mesh-belt system 5 has two endless mesh-belt sections 6 and 7 with substantially coplanar upper reaches. The two mesh belt sections 6 and 7 are each carried on four respective rollers 20 and together define a transfer gap or area 11. It is also possible to replace the two mesh belts 6 and 7 with a single mesh belt 6 to produce the configuration of FIG. 1.

Figure 3:
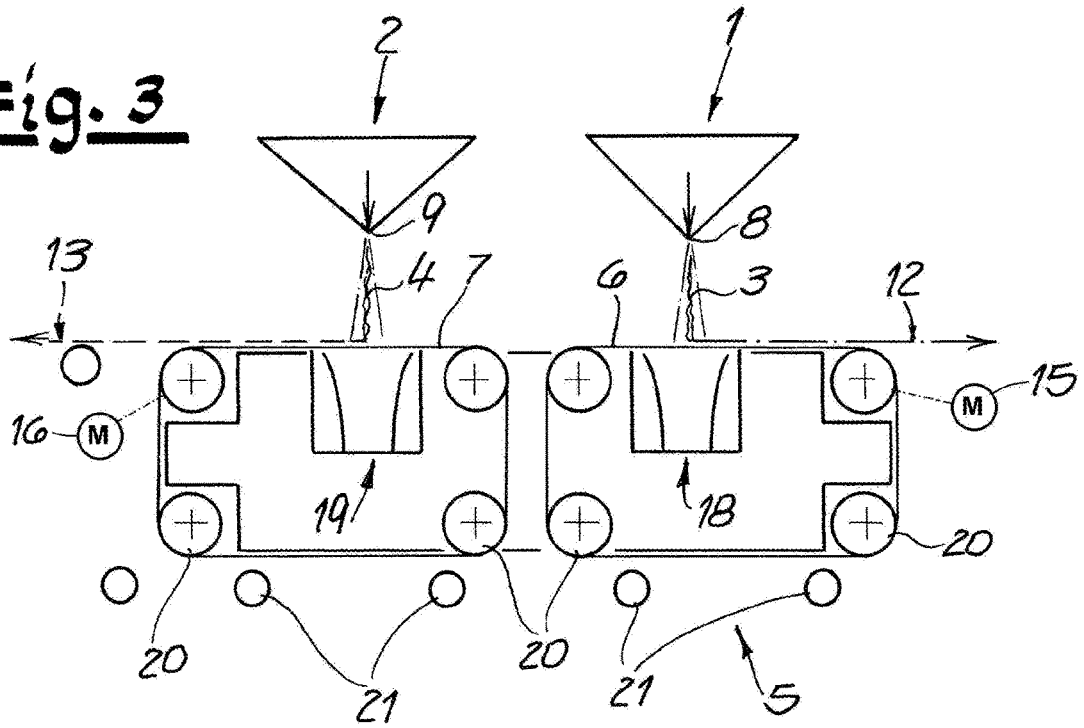
FIG. 3 is a schematic side view according to the invention of a second embodiment of an apparatus for making nonwoven in a first mode of operation.

FIG. 3 shows a simplified version of the mesh-belt system 5 from FIG. 2 in a first operating mode. Here the two mesh belts 6 and 7 are driven in opposite directions by respective drive motors 15 and 16, so that the first nonwoven web layer 12 composed of first fibers 3 of the first melt-blowing spinneret 1 moves opposite the direction D to the right as shown in FIG. 3 and the second nonwoven web 13 of the second fibers 4 of the second melt-blowing spinneret 2 is transported to the left. What is not shown is that two nonwoven webs 12 and 13 are wound up separately from one another. So in FIG. 3, it is possible to make two completely independent nonwovens 14 are possible.

Figure 4:
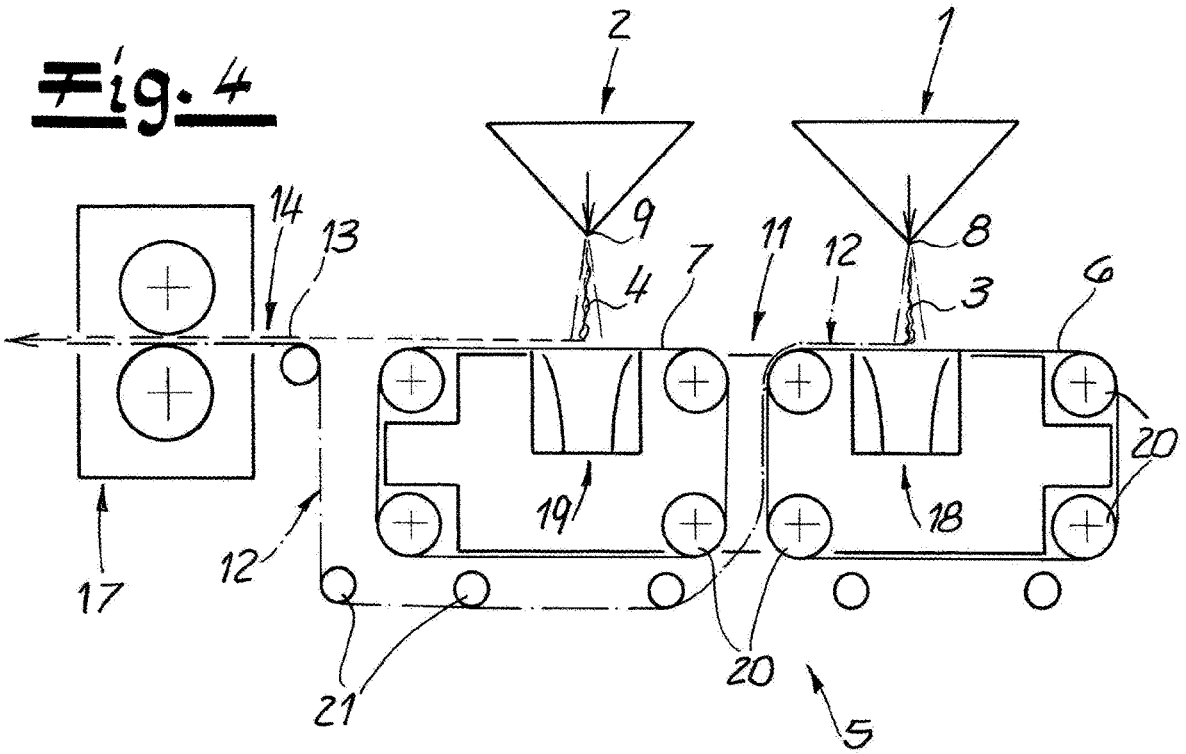
FIG. 4 shows the apparatus for making nonwoven of FIG. 3 in a second operating mode.

In FIG. 4, a second mode of operation of the mesh-belt system 5 from FIG. 2 is shown. Here the mesh belts 6 and 7 are both run counterclockwise. The first nonwoven web layer 12 from the first fibers 3 are deflected downward in the transfer gap 11. The nonwoven web layer 12 is then moved by the web rollers 21 under the second mesh belt 7. The mesh belt rollers 21 bring the two nonwoven webs 12, 13 together so that a multilayer nonwoven 14 with a first layer 12 and a second nonwoven web layer 13 is created. The multilayer nonwoven 14 is finally consolidated by the consolidater 17. The heat of the second fibers 4 is largely dissipated before it is juxtaposed with the layer 12 of the first fibers 3. The separate guidance of the first nonwoven web layer 12 makes it possible to treat the first nonwoven web layer 12 before the nonwoven webs 12, 13 are brought together in a separate unillustrated treatment facility.

Figure 5:
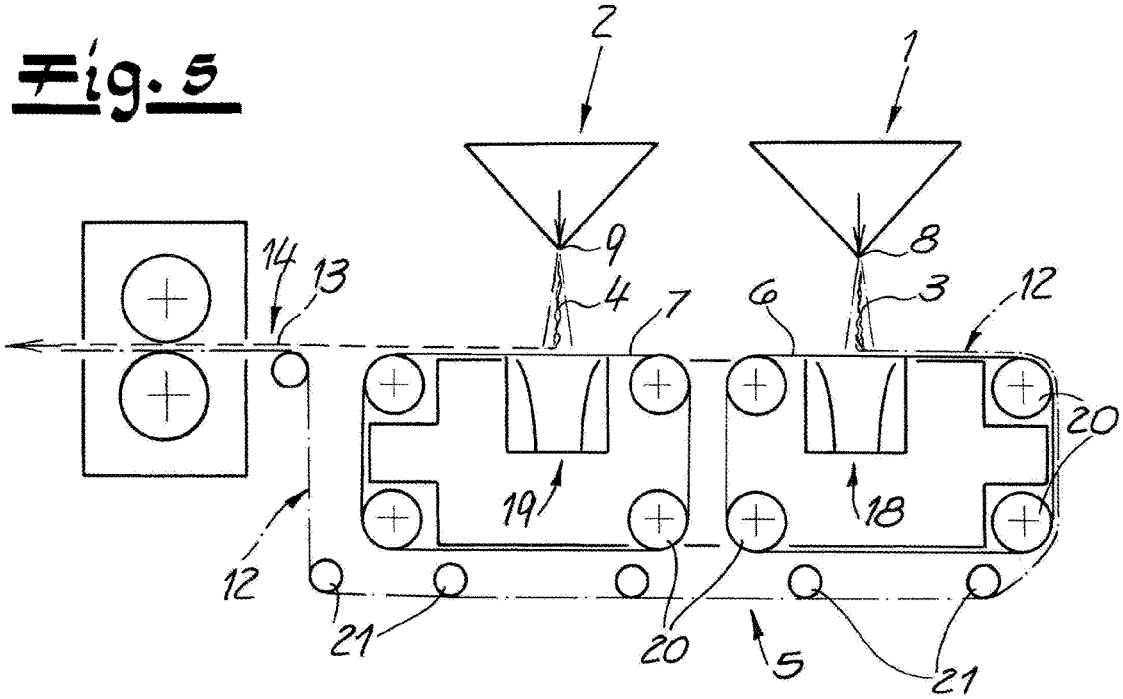
FIG. 5 shows the apparatus for making nonwoven from FIG. 3 in a third operating mode.
Figure 6:
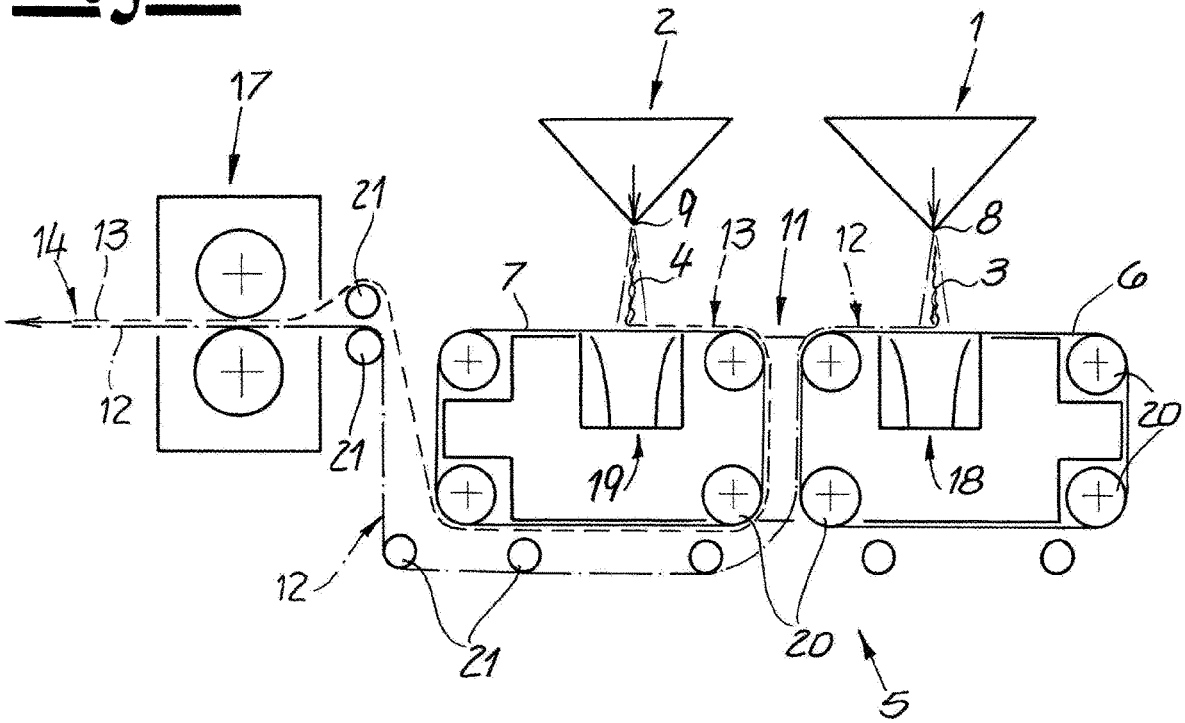
FIG. 6 shows the apparatus for making nonwoven of FIG. 3 in a fourth operating mode.

In FIG. 5, in contrast to FIG. 4, the direction of the first mesh belt 6 is now clockwise. As a result, the first nonwoven web layer 12 is turned relative to the second nonwoven web 13, which is particularly important if the first nonwoven web layer 12 itself is already multilayered. In the case of FIG. 6, it is finally shown that the mesh belts 6 and 7 can move in opposite directions compared to FIG. 5, so that for example turning the second nonwoven web 13 is also possible. Thus, FIGS. 3 to 6 show the great flexibility that results when using two mesh belts 6 and 7.

We claim:

1. An apparatus for making nonwoven, the apparatus comprising:

a mesh-belt system having an upstream endless section and a downstream endless section aligned therewith in a horizontal direction;

respective upstream and downstream spinnerets spaced apart in the direction above the upstream and downstream sections of the mesh-belt system, having downwardly opening tips at respective vertical spacings above the respective sections of the mesh-belt system, and each emitting fibers that are deposited at locations on the respective sections of the mesh-belt system directly below the spinnerets to form on the respective sections respective nonwoven layers;

a support carrying the mesh-belt system;

means for moving the support and thereby orienting the mesh-belt system into a position forming an acute angle with respect to horizontal and thereby varying the spacings; and upstream and downstream drive means respectively connected to the upstream and downstream sections for independently moving same in or against the direction.

2. The apparatus according to claim 1, wherein the support is pivotal about a horizontal axis.

3. The apparatus according to claim 2, wherein the means for moving the support lifts and/or pivots the support.

4. The apparatus according to claim 3, wherein the axis extends transversely to the direction.

5. The apparatus according to claim 4, wherein the axis is, relative to a longitudinal extension of the mesh-belt system, in a middle third of the mesh-belt system.

6. The apparatus according to claim 5, wherein the angle is +/−10° relative to horizontal.

7. The apparatus according to claim 3, wherein the means for moving the support can lift an upstream or downstream end of the mesh-belt system from a level horizontal position of the mesh-belt system by 100 to 500 mm.

8. An apparatus for making nonwoven, the apparatus comprising:

a mesh-belt system having an upstream endless section and a downstream endless section aligned therewith in a horizontal direction;

respective upstream and downstream spinnerets spaced apart in the direction above the upstream and downstream sections of the mesh-belt system, having downwardly opening tips at respective vertical spacings above the respective sections of the mesh-belt system, and each emitting fibers that are deposited at respective locations on the mesh-belt system directly below the spinnerets to form on the respective sections respective nonwoven layers;

a support carrying the mesh-belt system;

means for moving the support and thereby orienting the mesh-belt system into a position forming an acute angle with respect to horizontal and thereby varying the spacings; and guide means for moving one of the layers under the endless section on which the other layer is deposited.

9. An apparatus for making a multilayer nonwoven, the apparatus comprising:

a base;

a support carried by the base;

an endless belt system supported on and movable with the support and having an upper reach extending generally horizontally;

a drive for advancing the belt system such that the upper reach moves in a machine direction;

upstream and downstream spinnerets fixed above the base, separated in the direction by a gap, having downwardly open tips spaced apart in the direction at vertically fixed positions at respective spacings above respective deposition locations on the belt system, and emitting melt-blown fibers that drop from the tips onto the respective deposition locations to form respective layers;

a pivot supporting the support and belt system on the base for pivoting about a horizontal axis transverse to the direction;

a guide on the base only allowing the pivot to move vertically; and actuators for raising and lowering the pivot on the base and for pivoting the support on the base about the axis to vary the spacings.

10. The apparatus according to claim 9, wherein the belt system has an upstream endless section and a downstream endless section under the respective upstream and downstream spinnerets and separated by a gap, the drive including an upstream and downstream drive each capable of rotating the respective section such that it moves in or against the direction.

11. A method of operating the apparatus of claim 10, the method comprising the steps of:

in a first operating mode, driving the upper reaches of both sections in the same direction and thereby passing fibers deposited on the upstream section across the gap to the downstream section where the downstream spinneret deposits fibers on the fibers from the upstream section;

in a second operating mode, driving the upper reaches of both sections in the same direction while guiding the fibers while deflecting the fibers from the upstream section down into the gap and under the downstream section, and thereafter uniting the fibers from the upstream section with the fibers from the downstream section at a downstream end of the upper reach of the downstream section; and in a third operating mode, driving the upper reaches of the sections oppositely in respective directions away from the gap and deflecting the fibers down from an upstream end of the upstream reach and then under both of the sections, and thereafter uniting the fibers from the upstream section with the fibers from the downstream section at a downstream end of the upper reach of the downstream section.

* * * * *